US006318048B1

(12) United States Patent
Sambuca, Jr.

(10) Patent No.: US 6,318,048 B1
(45) Date of Patent: Nov. 20, 2001

(54) CASE SEALER MAST AND TROLLEY ASSEMBLY

(75) Inventor: Anthony J. Sambuca, Jr., Hawley, PA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/414,489

(22) Filed: Oct. 8, 1999

(51) Int. Cl.[7] ..... B65B 61/00

(52) U.S. Cl. ..... 53/136.4; 53/136.3; 493/475; 493/478; 493/479

(58) Field of Search ..... 16/197; 53/136.4, 53/136.3; 493/475, 478, 479, 78, 116; 267/156

(56) References Cited

U.S. PATENT DOCUMENTS

| | | | | |
|---|---|---|---|---|
| 3,820,193 | * | 6/1974 | Foster | 16/197 |
| 4,044,527 | * | 8/1977 | Ulrich et al. | 53/136.4 |
| 4,542,616 | * | 9/1985 | Ulrich et al. | 53/136.4 |
| 4,781,786 | * | 11/1988 | Lerner et al. | 53/136.4 |
| 4,955,177 | * | 9/1990 | Lerner et al. | 53/136.4 |

* cited by examiner

*Primary Examiner*—Peter Vo
*Assistant Examiner*—Thanh K Truong
(74) *Attorney, Agent, or Firm*—Schwartz & Weinrieb

(57) ABSTRACT

A mast and trolley assembly for a case sealer machine includes a set of fixed bearing members mounted upon the trolley assembly, and a set of movably adjustable bearing members mounted upon the trolley assembly such that opposite sides of the trolley assembly will engage the mast member with the proper degree of tension whereby adjustable vertical movements of the trolley assembly along the mast member are smoothly accomplished without any play or chatter. The machine head assembly is also bolted to the trolley assembly such that replacement or exchange of different sized head assemblies are readily, easily, and quickly achieved. A coiled spring mechanism is mounted upon the mast member and operatively attached to the trolley assembly so as to counterbalance the weight of the trolley and head assemblies thereby rendering the vertical adjustments of the head and trolley assemblies along the mast member easy to achieve in a counterbalanced manner. A mast guard, a mast cap, a spring guard, and a trolley guard enclose the various operative components of the machine so as to eliminate safety hazards for operator personnel.

24 Claims, 8 Drawing Sheets

CASE SEALER MAST AND TROLLEY ASSEMBLY

FIELD OF THE INVENTION

The present invention relates generally to case, carton, or box sealing machines, equipment, or apparatus, and more particularly to a new and improved mast and trolley assembly for mounting the trolley assembly upon the machine, equipment, or apparatus mast so as to be readily, easily, and quickly be capable of elevationally adjusting the equipment or machine head assembly which is mounted upon the apparatus trolley assembly.

BACKGROUND OF THE INVENTION

Case, carton, or box sealing machines, equipment, or apparatus conventionally comprise a base frame assembly to which a vertically extending mast member is fixedly secured. The vertically extending mast member has a trolley assembly movably mounted thereon such that the trolley assembly is capable of being disposed at any one of an infinite number of vertical positions with respect to the vertically extending mast member. The trolley assembly, in turn, supports a head assembly upon which the various case, box, or carton sealing mechanisms are disposed. Consequently, as a result of the vertical adjustability of the head assembly with respect to the vertically extending mast member, due to the vertically adjustable movement capabilities of the trolley assembly relative to the vertically extending mast member, the various case, carton, or box sealing mechanisms can be appropriately vertically positioned or disposed with respect to the particular case, box, or carton to be sealed.

In accordance with a first type of conventional case, box, or carton sealer machine, equipment, or apparatus, the vertical adjustment of the head and trolley assemblies with respect to the vertically extending mast member comprises a vertically extending shaft and a rotary crank mechanism whereby rotation of the rotary crank mechanism in effect converts the rotary motion into vertical translation of the head and trolley assembly along the vertically extending shaft. While this system is obviously viably operational, the operation of such a rotary crank mechanism is cumbersome, tedious, and slow when, for example, rapid or large vertical movements of the head and trolley assemblies with respect to the vertically extending shaft are desired or required. In accordance with a second type of conventional case, box, or carton sealer machine, equipment, or apparatus, the vertically adjustable trolley assembly, for moving the head assembly with respect to the vertically extending mast member, comprises a welded assembly which limits the flexibility and versatility of the system. More particularly, if, for example, a different sized head assembly is to be mounted upon the trolley assembly so as to operatively accommodate different sized cases, cartons, boxes, or the like to be closed and sealed, the welds have to be disassembled or broken so as to remove the old head assembly and the new head assembly welded onto the trolley assembly. This procedure is obviously very time-consuming and costly. In addition, the bearing members comprise conventional radial-type bearing assemblies which limit the load-bearing capacity or capabilities of the trolley assembly, which is supporting the head assembly in a cantilevered manner, with respect to the movements of the head and trolley assemblies along the vertically extending mast member. Still further, many of the operative components of the mast and trolley assemblies are not sufficiently enclosed whereby such operative components present safety hazards to operator personnel.

A need therefore exists in the case, carton, or box sealer art for a new and improved case, carton, or box sealer machine, apparatus, or equipment which comprises a new and improved mast and trolley assembly wherein the vertical adjustments of the machine head and trolley assemblies along the mast member can be readily, easily, and quickly achieved. In addition, there is a need in the art for providing a new and improved mast and trolley assembly with enhanced flexibility and versatility so as to accommodate, for example, different head assemblies, as well as sufficient load-bearing capabilities with respect to such different head assemblies. Still further, there is a need in the art for providing a new and improved mast and trolley assembly wherein the various operative components of the mast and trolley assemblies are sufficiently or properly enclosed such that the operative components do not present safety hazards to operator personnel

OBJECTS OF THE INVENTION

Accordingly, it is an object of the present invention to provide a new and improved case, carton, or box sealer machine, equipment, or apparatus.

Another object of the present invention is to provide a new and improved case, carton, or box sealer machine, equipment, or apparatus which effectively overcomes the various disadvantages or operative drawbacks characteristic of PRIOR ART case, carton, or box sealer machines, equipment, or apparatus.

An additional object of the present invention is to provide a new and improved case, carton, or box sealer machine, equipment, or apparatus wherein the vertical adjustments of the machine head and trolley assemblies along the mast member can be readily, easily, and quickly achieved, and the trolley assembly is such as to exhibit sufficient load-bearing capabilities.

A further object of the present invention is to provide a new and improved case, carton, or box sealer machine, equipment, or apparatus wherein the mast and trolley assembly exhibits enhance flexibility and versatility capabilities, and wherein the various operative components of the mast and trolley assemblies are properly or sufficiently enclosed such that the operative components do not present safety hazards to operator personnel.

SUMMARY OF THE INVENTION

The foregoing and other objectives are achieved in accordance with the teachings and principles of the present invention through the provision of a new and improved case, carton, or box sealer machine, equipment, or apparatus which comprises a base frame assembly; a vertical mast member which is bolted at its lower end portion to the machine base frame assembly so as to extend or project upwardly therefrom; a head assembly upon which, for example, the case, carton, or box tape cartridge, for taping or sealing the case, carton, or box, is carried or supported; and a trolley assembly adapted to be slidably mounted upon the vertically extending or upwardly projecting mast member and to which the head assembly is secured so as to permit vertical adjustment of the head assembly with respect to the vertically extending or upwardly projecting mast member.

A constant force spring is mounted upon the upper end portion of the mast member and is operatively connected to the trolley assembly so as to counterbalance the weight of the trolley and head assemblies and thereby aid in the vertically adjustable movements of the trolley assembly, and the head assembly attached thereto, with respect to and along the vertically extending or upwardly projecting mast member. The head assembly is also bolted to the trolley assembly so as to render the machine or equipment flexible and versatile whereby a head replacement or exchange operation is relatively quick and easy without substantial machine or equipment downtime. A mast cap, a spring guard, a mast guard, and a trolley guard are also mounted upon the mast and trolley assembly components so as to effectively enclose the various internal components mounted upon the mast and trolley assembly in order to protect operator personnel.

In accordance with the unique trolley assembly of the present invention, the trolley assembly is adapted to effectively encircle the mast member, and the trolley assembly is provided with two sets of four bearing members which respectively engage two opposite sides of the mast member, while a pair of wear strips respectively engage the other two opposite sides of the mast member. One of the wear strips is fixed and the other wear strip is adjustable, and in a similar manner, one of the sets of bearings is fixed while the other set of bearings is adjustable. Accordingly, the trolley assembly is adjustably engaged upon the mast member such that the trolley assembly is movable along the mast member in a smooth manner without any play defined between the mast member and the trolley assembly and without generating any noise or chatter. In addition to the aforenoted structure, the trolley assembly also comprises a locking or clamping screw which is lockingly engageable with the mast member so as to lock the trolley assembly at a particularly desired vertical position along the mast member once the trolley assembly has been moved to the selected vertical position.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
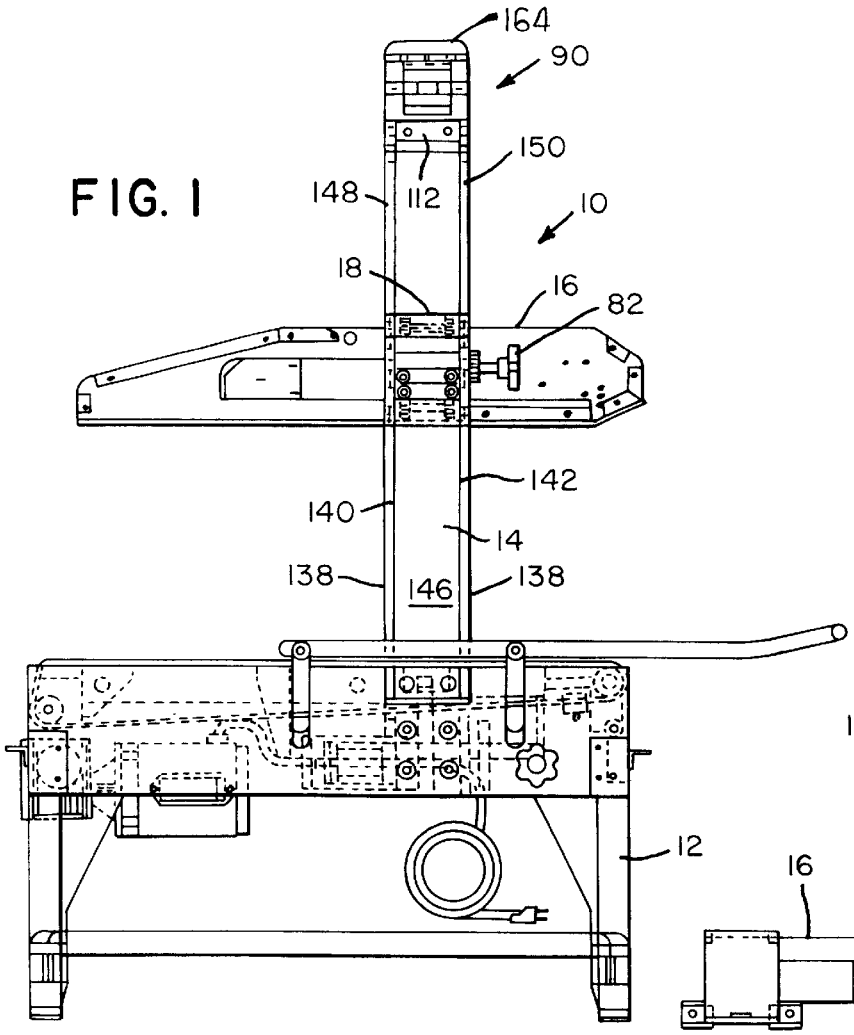
FIG. 1 is a front elevational view, partly in cross-section, of a case sealer machine in connection with which the new and improved mast and trolley assembly system, constructed in accordance with the principles and teachings of the present invention, may be employed.

Referring now to the drawings, and more particularly to FIG. 1 thereof, a case sealer machine, in connection with which the new and improved mast and trolley assembly system, which has been constructed in accordance with the principles and teachings of the present invention as will be described more fully hereinafter, may be employed, is disclosed and is generally indicated by the reference character 10. In view of the fact that the various operative components of the case sealer machine 10, other than the new and improved mast and trolley assembly system, are not actually part of the present invention, only a brief description of the case sealer machine 10 per se will be described, and such description will then be followed by a detailed description of the new and improved mast and trolley assembly system comprising the present invention.

Figure 2:
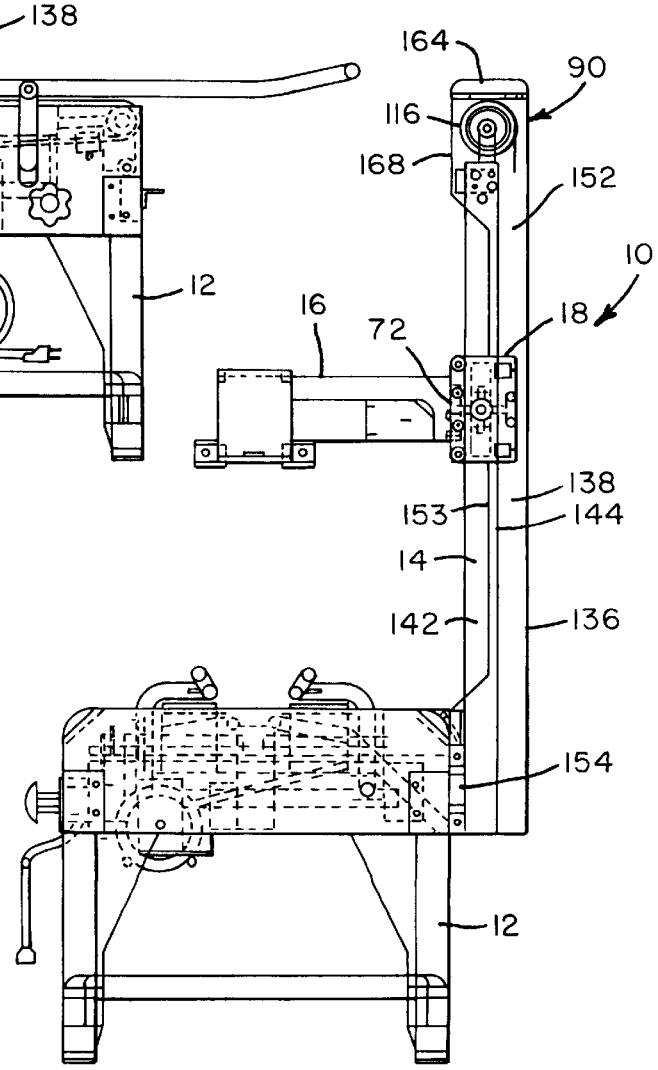
FIG. 2 is a side elevational view, partly in cross-section, of the case sealer machine disclosed within FIG. 1.

Accordingly, it is to be appreciated that the case sealer machine 10 comprises a base frame assembly 12 which of course serves to support the machine upon a production facility floor or other platform. A vertically upstanding mast 14 is fixedly secured at its lower end to a rear portion of the base frame assembly 12 as best seen in FIG. 2 such that the mast 14 projects upwardly from the base frame assembly 12, and a head assembly 16 is adapted to be adjustably mounted upon the mast 14 by means of a slidable trolley assembly 18. The head assembly 16 serves to mount a tape cartridge, not shown, for use in taping or sealing cases, cartons, boxes, and the like, which are adapted to be sealed by means of the case sealer machine 10.

With reference now being made to FIGS. 3–7, details of the trolley assembly 18, and how the trolley assembly 18 is mounted upon and operatively interacts with the mast member 14, will be set forth and described. As best seen, for example, in FIG. 7, the trolley assembly 18 is adapted to annularly surround or encircle the mast member 14 which for illustrative purposes has been illustrated in dotted lines. The trolley assembly 18 is provided with a unique mounting system which comprises first and second adjustable means for adjustably engaging the mast member 14 such that as a result of the adjustment of the first adjustable means, the trolley assembly 18 is movably mounted upon the mast member 14 in vertically upward and downward modes without any relative play or looseness existing between the mast member 14 and the trolley assembly 18, and wherein further, chatter or noise will not be generated when vertical adjustment movements of the trolley assembly 18 with respect to the mast member 14 are being performed. As a result of the adjustment of the second adjustable means, the trolley assembly 18 is effectively locked at a particular vertical elevation with respect to the mast member 14 such that a particular case sealing operation can be performed upon a case, carton, box, or the like by means of the head assembly 16 and the tape cartridge mounted thereon.

More particularly, the mounting system for mounting the trolley assembly 18 upon the mast member 14 is seen to comprise a fixed-side trolley plate 20 and a locking-side trolley plate 22. The interior surface of the fixed-side trolley plate 20 is seen to comprise a recessed portion 24 within which a fixed-side wear strip 26 is fixedly disposed, by means of a suitable fastener, not shown, such that the fixed-side wear strip 26 engages, for example, the left side, as considered or viewed in FIG. 1, of the mast member 14. The interior surface of the locking-side trolley plate 22 is likewise provided with a recessed portion 28 within which a locking-side wear strip 30 is disposed in a substantially friction-fit manner. The locking-side wear strip 30, therefore, is not fixed upon the locking-side trolley plate 22 but is movable within the recessed portion 28 thereof by means of four set screws 32 which project through apertures 34 defined within the locking-side trolley plate 22 and engage the locking-side wear strip 30 so as to effectively move the locking-side wear strip 30 into engagement with the right side, as considered in FIG. 1, of the mast member 14 with a desired amount of force. In this manner, the right and left sides of the trolley assembly 18, that is, the locking-side of the trolley assembly 18 and the fixed-side of the trolley assembly 18, snugly engage the right and left sides of the mast member 14.

The front side of the trolley assembly 18 comprises a set of four bearing assemblies which include rotatable bearing members 36 which are respectively disposed at the four corners of the front side of the trolley assembly 18 such that the bearing members 36 may be considered to be disposed either in upper and lower laterally or horizontally spaced pairs of bearing members 36, or left and right side vertically spaced pairs of bearing members 36. Suitable bolt fasteners 38, projecting inwardly from the fixed-side trolley plate 20 and the locking-side trolley plate 22 threadedly engage axial portions of the bearing assemblies such that the rotational axes of the bearing assemblies are fixed while nevertheless permitting the bearing members 36 to rotate, bearing spacers 40 being respectively axially interposed between the bearing members 36 and the fixed-side trolley plate 20 as well as between the locking-side trolley plate 22 and the bearing members 36. It is to be appreciated that in accordance with the mast and trolley assembly of the present invention, the bearing members 36 are disposed in contact with the front side of the mast member 14.

In a similar manner, the rear side of the trolley assembly 18 also comprises a set of four bearing assemblies which include rotatable bearing members 42 which are respectively disposed at the four corners of the rear side of the trolley assembly 18 such that the bearing members 42 may likewise be considered to be disposed either in upper and lower laterally or horizontally spaced pairs of bearing members 42, or left and right side vertically spaced pairs of bearing members 42. Each upper and lower set of bearing members 42 is supported upon a bearing-support bar 44 the details of which are more clearly illustrated in FIG. 8. The bearing-support bar 44 comprises an enlarged diameter central section 46 and a pair of bearing-support shaft sections 48 and 50, having smaller diametrical extents than that of the central section 46, extending axially outwardly in opposite directions from the central section 46. In this manner, shoulder portions 52 are respectively defined between each end of the central section 46 and a respective one of the bearing-support shaft sections 48,50. As can be appreciated from FIGS. 6 and 7, when the bearing members 42 are mounted upon the bearing-support bar 44, and in particular upon the bearing-support shaft sections 48,50, the bearing members 42 will abut against the shoulder portions 52.

Figure 6:
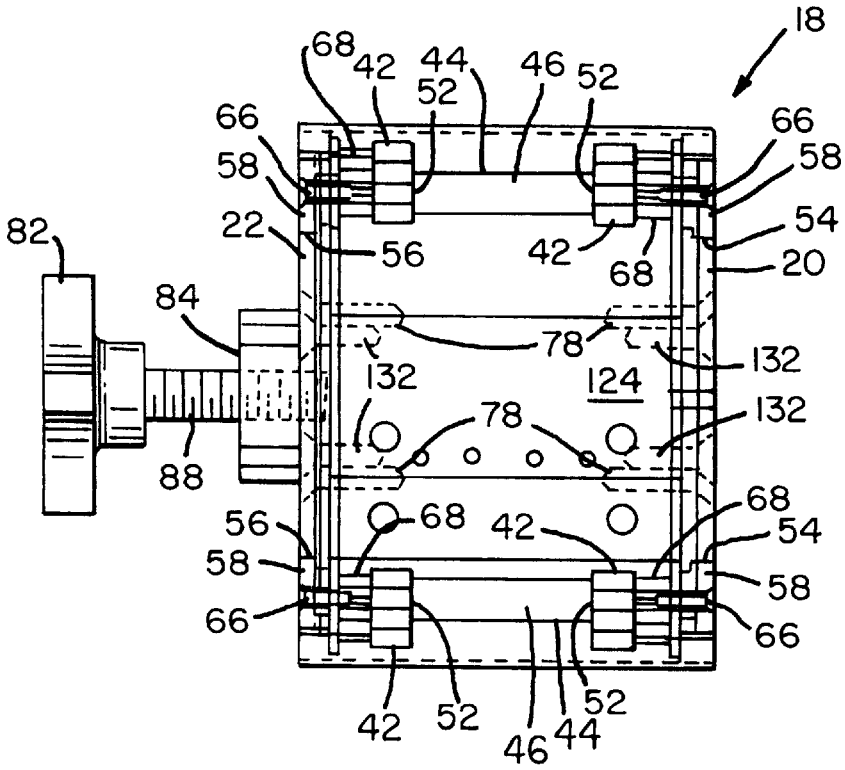
FIG. 6 is a rear elevational view of the trolley assembly as shown in FIG. 5.
Figure 7:
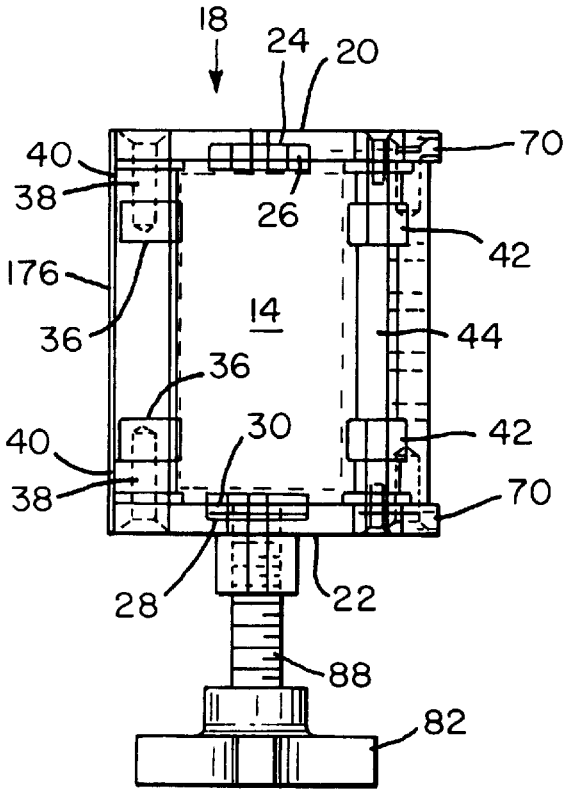
FIG. 7 is a top plan view of the trolley assembly shown in FIG. 5 wherein it is schematically illustrated how the trolley assembly is mounted upon the mast member.
Figure 8:
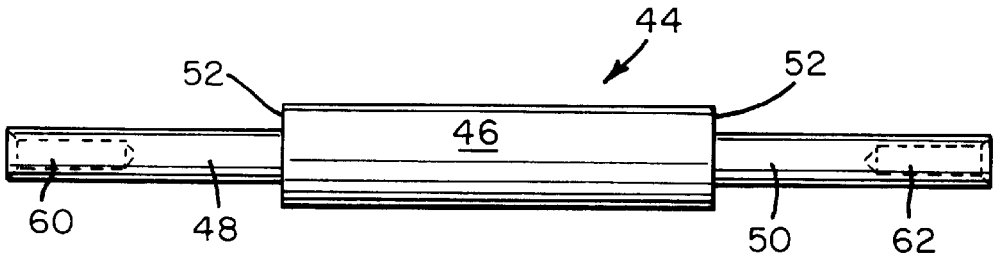
FIG. 8 is a front elevational view of the bearing-support bar utilized within the trolley assembly.
Figure 9:
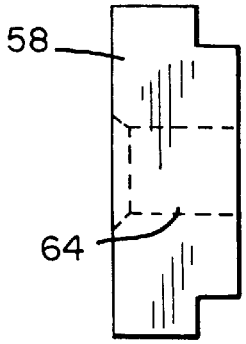
FIG. 9 is a side elevational view of a tee-nut member used in conjunction with the adjustable bearing members of the trolley assembly.

As can best be appreciated with reference again being made to FIGS. 5–7, the rear side of each one of the fixed-side and locking-side trolley plates 20,22 is provided with substantially rectangular slots or apertures 54,56 within the upper and lower regions thereof, wherein each one of the slots or apertures 54,56 has a substantially T-shaped cross-sectional configuration as may be best appreciated from FIG. 6. Tee-nut members 58, having a substantially T-shaped cross-sectional configuration matching the cross-sectional configuration of the slots or apertures 54,56, and as illustrated in FIG. 9, are adapted to be disposed within the T-shaped slots or apertures 54,56 of the fixed-side and locking-side trolley plates 20,22. The opposite distal ends of the bearing-support shaft sections 48,50 of the bearing-support bar 44 are provided with tapped or threaded bores 60,62, and each one of the tee-nut members 58 is similarly provided with a through bore 64. In this manner, suitable bolt fasteners 66 are inserted through the through-bores 64 of the tee-nut members 58 and threadedly engage the tapped bores 60,62 of the bearing-support shaft sections 48,50. As was the case with the bearing members 36 disposed upon the front side of the trolley assembly 18, bearing spacers 68 are disposed upon the bearing-support shaft sections 48,50 so as to be interposed between the tee-nut members 58 and the bearing members 42 as best seen in FIGS. 6 and 7.

Figure 5:
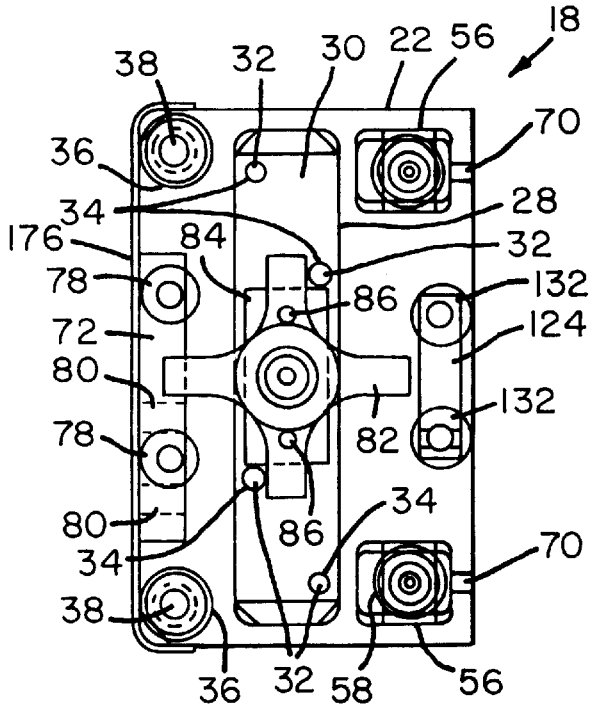
FIG. 5 is a side elevational view similar to that of FIG. 3 showing, however, only the trolley assembly constructed in accordance with the principles and teachings of the present invention.

As can best be appreciated from FIG. 5, the longitudinal extent of each one of the substantially rectangular slots or apertures 54,56 is greater than the diametrical extent of the tee-nut members 58, and consequently, the tee-nut members 58 are able to move longitudinally within the slots or apertures 54,56. In order to effectuate such movement of the tee-nut members 58 within the slots or apertures 54,56, which comprises a unique feature of the trolley assembly of the present invention, apertures 70, as best seen in FIG. 5, are respectively provided within both the upper and lower regions of both of the fixed-side and locking-side trolley plates 20,22 such that set screws, not shown, can be inserted therethrough and engage the tee-nut members 58. In this manner, as the set screws, not shown, are rotated, they effectively serve as jacking components which forcefully move the tee-nut members 58, and therefore the bearing members 42, toward the interior of the trolley assembly 18 such that the bearing members 42 engage the rear side of the mast member 14 as may best be appreciated from FIG. 7. Consequently, as a result of such positional adjustment of the bearing members 42, as well as the aforenoted positional adjustment of the lockgin-side wear strip 30, the trolley assembly 18 is positionally adjusted in a relatively snug manner upon the mast member 14 such that when the trolley assembly 18 is slidably moved upwardly and downwardly along the mast member 14, such movements are able to be conducted in a relatively smooth, stable manner and without any undesirable noise or chatter.

Figure 10:
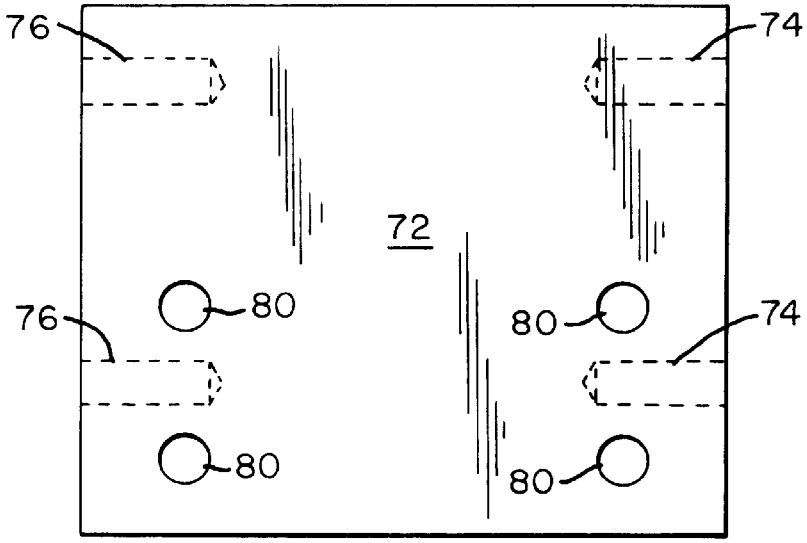
FIG. 10 is a front elevational view of the trolley front plate component of the trolley assembly.

Once the trolley assembly 18, and the head assembly 16 attached thereto, have been moved either upwardly or downwardly with respect to the mast member 14 as has been noted hereinbefore, it is then of course desirable to positionally lock the trolley assembly 18, and the head assembly 16 attached thereto, at a particular elevational position with respect to the mast member 14. In order to in fact attach the head assembly 16 to the trolley assembly 18, the trolley assembly 18 further comprises a trolley front plate member 72 which is best shown in FIGS. 5 and 10. The opposite side edge portions of the trolley front plate 72 are seen to be provided with upper and lower, laterally extending tapped blind bores 74,76 within which suitable threaded bolt fasteners 78, inserted through apertures defined within the fixed-side trolley plate 20 and the locking-side trolley plate 22, are adapted to be threadedly engaged such that the trolley front plate 72 is fixedly secured upon the trolley assembly 18. In addition, the trolley front plate 72 is also provided with four tapped bores 80 within which additional suitable bolt fasteners, not shown, can be threadedly engaged so as to mount the proximal end of the head assembly 16 upon the trolley front plate 72 as can be appreciated from FIG. 2. This is a unique feature of the trolley and mast system of the case sealer machine 10 in that by means of simply bolting the head assembly 16 to the trolley assembly 18, different head assemblies can be readily, easily, and quickly exchanged simply by removing the bolt fasteners, not shown, removing a particular head assembly, replacing the removed head assembly with a new head assembly, and reattaching the new head assembly to the trolley assembly 18 by reinserting the threaded bolt fasteners, not shown, into the tapped bores 80 of the trolley front plate 72.

Reverting back to the discussion of positionally locking the trolley assembly 18, and the head assembly 16 mounted thereon, at a particular elevational position with respect to the mast member 14, a handle, locking knob, or clamping screw 82 is provided. A lock nut or clamp nut 84 is fixedly secured to the locking-side trolley plate 22 by means of suitable bolt fasteners, not shown, which are inserted within a pair of vertically spaced tapped bores 86 which are defined within the locking-side trolley plate 22. Corresponding non-tapped bores, not shown, are provided within the the locking-side wear strip 30 so as to permit the locking-side wear strip 30 to be positionally adjusted with respect to the trolley assembly 18 and the mast member 14 as previoiusly discussed without interfering with the fixed mounting of the lock nut or clamp nut 84 upon the locking-side trolley plate 22.

As best seen in FIGS. 6 and 7, the shank 88 of locking knob or clamping screw 82 is externally threaded, and the lock nut or clamp nut 84 is internally threaded such that the shank 88 of the locking knob or clamping screw 82 is threadedly engaged within the lock nut or clamp nut 84. The locking-side trolley plate 22 and the locking-side wear strap 30 are also provided with non-tapped apertures for permitting the distal end of the shank 88 of the locking knob or clamping screw 82 to project therethrough, without operationally interfering therewith, when the locking knob or clamping screw 82 is threadingly rotated so as to effectively translate into the interior of the trolley assembly 18 as can be best appreciated from FIG. 7. In this manner, when the locking knob or clamping screw 82 is threadingly rotated and translated, the distal end of the shank 88 of the locking knob or clamping screw 82 will engage the right side of the mast member 14 as considered or viewed in FIG. 1 whereby the entire trolley assembly 18, and the head assembly 16 mounted and carried thereon, will be lockingly engaged with the mast member 14 such that the elevational disposition of the trolley assembly 18 and the head assembly 16 will be fixed with respect to the mast member 14. Elevational positional adjustments of the trolley assembly 18 and the head assembly 16 can therefore subsequently be accomplished simply by loosening the locking knob or clamping screw 82 by unthreading the same with respect to the lock nut or clamp nut 84, elevationally moving the trolley and head assemblies 18,16 to a newly desired elevational position, and subsequently retightening the locking knob or clamping screw 82 with respect to the lock nut or clamp nut 84.

Figure 11:
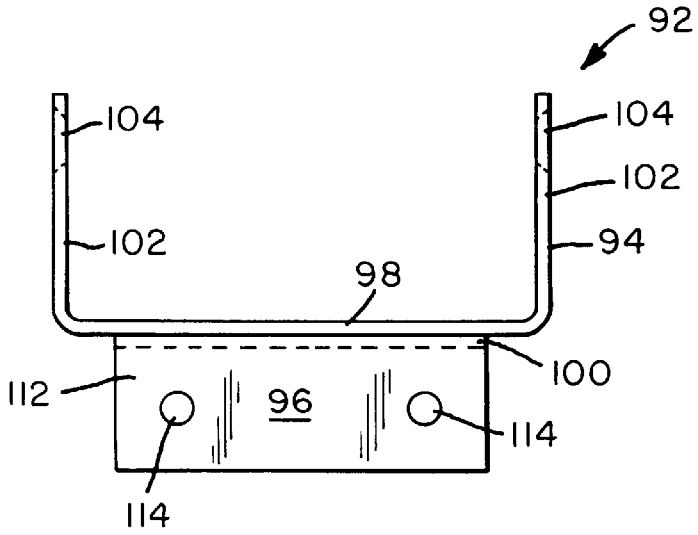
FIG. 11 is a front elevational view of a coil spring holder for the trolley assembly coil spring member.
Figure 12:
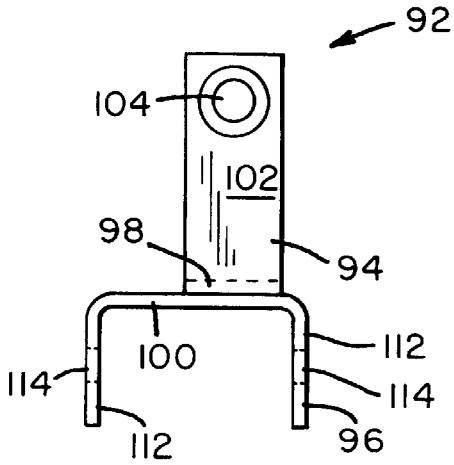
FIG. 12 is a side elevational view of the coil spring holder shown in FIG. 11.
Figure 13:
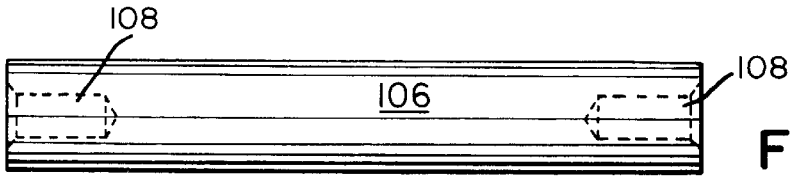
FIG. 13 is a front elevational view of a coil spring shaft for the coil spring member.

In order to facilitate the elevational positioning operations of the trolley and head assemblies 18,16, when the locking knob or clamping screw 82 is loosened with respect to the mast member 14, by counter balancing the weight of the trolley and head assemblies 18,16 when the trolley and head assemblies 18,16 are being positionally moved either upwardly or downwardly along the mast member 14, the mast and trolley assembly further comprises a coil spring mechanism which is generally illustrated in FIGS. 1–4 and indicated by the reference character 90. More specifically, a coil spring holder 92, which is illustrated in detail in FIGS. 11 and 12, is seen to comprise an upwardly open U-shaped spring shaft support member 94, and a downwardly open inverted U-shaped support bracket 96. Respective base portions 98 and 100 of the shaft support member 94 and the support bracket 96 are affixed to each other, such as, for example, by welding, and the upwardly projecting legs 102 of the shaft support member 94 are provided with axially aligned holes or apertures 104. The shaft support member 94 is adapted to fixedly support a spring shaft 106 which is illustrated in FIG. 13, and it is seen that opposite ends of the spring shaft 106 are provided with tapped holes 108 for receiving threaded bolts 110 which are inserted through the holes or apertures 104 of the shaft support member 94 and into the tapped bores or holes 108 of the spring shaft 106 as may be appreciated from FIG. 4. As will be discussed shortly, the spring shaft 106 will support a coil spring member of the coil spring mechanism 90.

Figure 14:
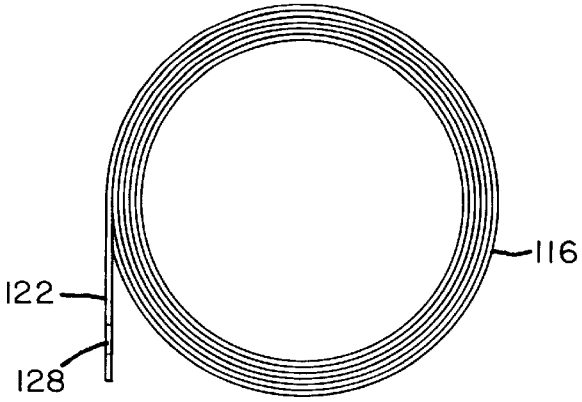
FIG. 14 is a side elevational view of the trolley assembly counter balancing coil spring member.
Figure 15:
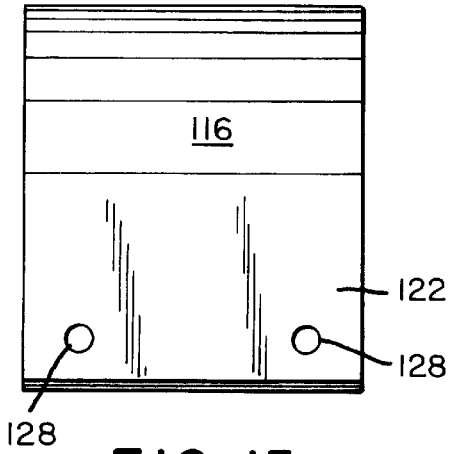
FIG. 15 is at front elevational view of the coil spring member shown in FIG. 14.

The inverted U-shaped support bracket 96 similarly comprises a pair of dependent legs 112,112 which are also respectively provided with axially aligned apertures 114, 114. It will be appreciated that the axes defined between the apertures 104,104 of the spring shaft support member 94, and between the apertures 114 of the support bracket 96 are perpendicular to each other, and this arrangement permits the coil spring holder 92 to properly support a coil spring member 116 upon the spring shaft support member 94 while the support bracket 96 is fixedly attached to the upper end portion of the mast member 14, as can be appreciated from FIGS. 3 and 4, by means of suitable fasteners, not shown, which are inserted through apertures 114,114 and into tapped bores, also not shown, provided within the mast member 14. The coil spring member 116 is illustrated in FIGS. 14 and 15, and it is noted that the coil spring member 116 is comprised of coil spring steel which, as is known in the art, has a memory tending to recoil the coil spring when the spring has been uncoiled. An inner or beginning end portion of the spring member 116 is actually mounted upon or affixed to a spring hub member 118, as seen in FIGS. 1–4, which is freely rotatable upon the spring shaft 106, and in order to maintain the spring hub member 118 centered upon the spring shaft 106, a pair of spring shaft spacers 120,120 are mounted upon the opposite ends of the spring shaft 106 so as to be interposed between the spring hub member 118 and the upstanding legs 102,102 of the spring shaft support member 94.

Figure 16:
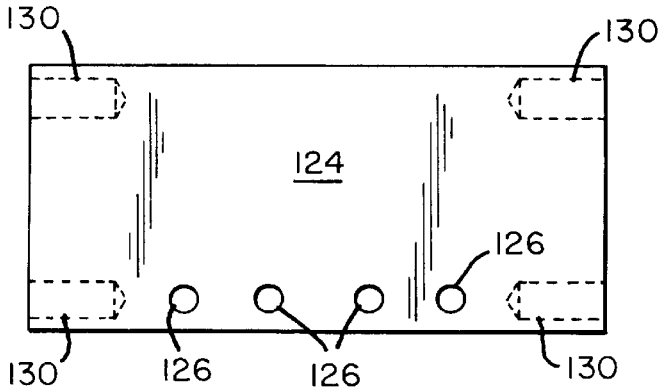
FIG. 16 is a front elevational view of a spring block member to be mounted upon the trolley assembly.

In order to affix the free end 122 of the coil spring member 116 to the trolley assembly 18 so as to counterbalance the weight of the trolley assembly 18 and the head assembly 16 as has been noted hereinbefore, a spring block 124, as illustrated in detail in FIG. 16, is affixed to the trolley assembly 18 as shown in FIGS. 3–6. More particularly, as best seen in FIG. 16, the spring block 124 is provided with four tapped bores 126, and it is seen from FIGS. 14 and 15 that the free end 122 of the coil spring member 116 is provided with a pair of apertures 128. Accordingly, suitable threaded fasteners, not shown, can be passed through the apertures 128 of the spring member 116 and into the tapped bores 126 of the spring block 124 so as to secure the free end 122 of the spring member 116 to the spring block 124. There are a greater number of bores 126 provided within the spring block 124 than the number of apertures 128 provided within the spring member 116 so as to accommodate different spring manufacturers wherein the spacing between apertures upon a particular spring member may differ. In order to secure the spring block 124 within the trolley assembly 18, opposite ends of the spring block 124 are provided with a pair of tapped bores 130 into which suitable threaded fasteners 132 can be inserted after such fasteners 132 have been passed through suitable apertures, not numbered, provided within the fixed-side trolley plate 20 and the locking-side trolley plate 22 as can be appreciated from FIGS. 5 and 6.

A last important feature of the present invention resides in the fact that all of the major operative components of the mast and trolley assembly are covered or enclosed by means of suitable removable guard structures so as to protect operator personnel. More particularly, it is firstly noted that the mast and trolley assembly, as illustrated and best seen, for example, in FIGS. 1–4, comprises a mast guard 134 which is illustrated in detail in FIGS. 17 and 18 and is seen to have a substantially three-sided, U-shaped configuration comprising a rear wall 136 and a pair of opposite side walls 138. It can readily be appreciated from FIGS. 1–4 that the mast guard 134 is adapted to cover or enclose three sides of the mast member 14, that is, the left side wall 140 of the mast member 14, the right side wall 142 of the mast member 14, and the rear side wall 144 of the mast member 14, as viewed or considered in FIGS. 1 and 4, while the front side wall 146 of the mast member 14 remains uncovered or unenclosed so as to permit the head assembly 16 to be attached to and project forwardly from the trolley assembly 18.

It is to be noted further that while the mast guard 134 encloses or covers three sides of the mast member 14, the opposite side walls 138 of the mast guard 134 are spaced from the side walls 140 and 142 of the mast member 14 so as to respectively define spaces or gaps 148 and 150 therebetween. In a similar manner, the rear wall 136 of the mast guard 134 is spaced from the rear side wall 144 of the mast member 14 so as to define a gap or space 152 therebetween. In this manner, the spaces or gaps 148,150,152 provided between the mast guard 134 and the mast member 14 permit the respective rear and side portions of the trolley assembly 18 to be disposed within such spaces so as to facilitate the vertical movements of the trolley assembly 18 along and with respect to the mast member 14 during vertical adjustable movements of the trolley and head assemblies 18,16. Each one of the opposite side walls 138 of the mast guard 134 is also seen to comprise a substantially rearwardly recessed or cut-out portion 153 which, as can best be appreciated from FIGS. 1–3, provides for operator access to the clamping screw or locking knob 82 upon the trolley assembly 18 which then effectively projects outwardly, in a sideways manner, through the recessed or cut-out portion 153 of the mast guard 134.

Figure 4:
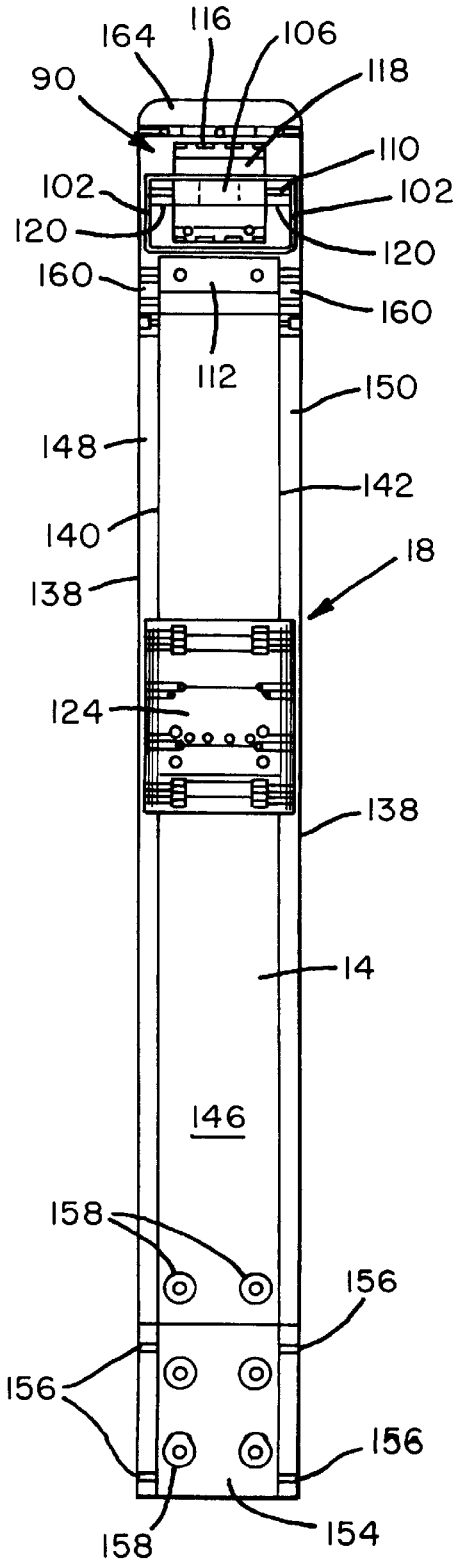
FIG. 4 is a front elevational view of the mast and trolley assembly shown in FIG. 3 with the trolley guard, trolley front plate, and spring guard removed.
Figure 17:
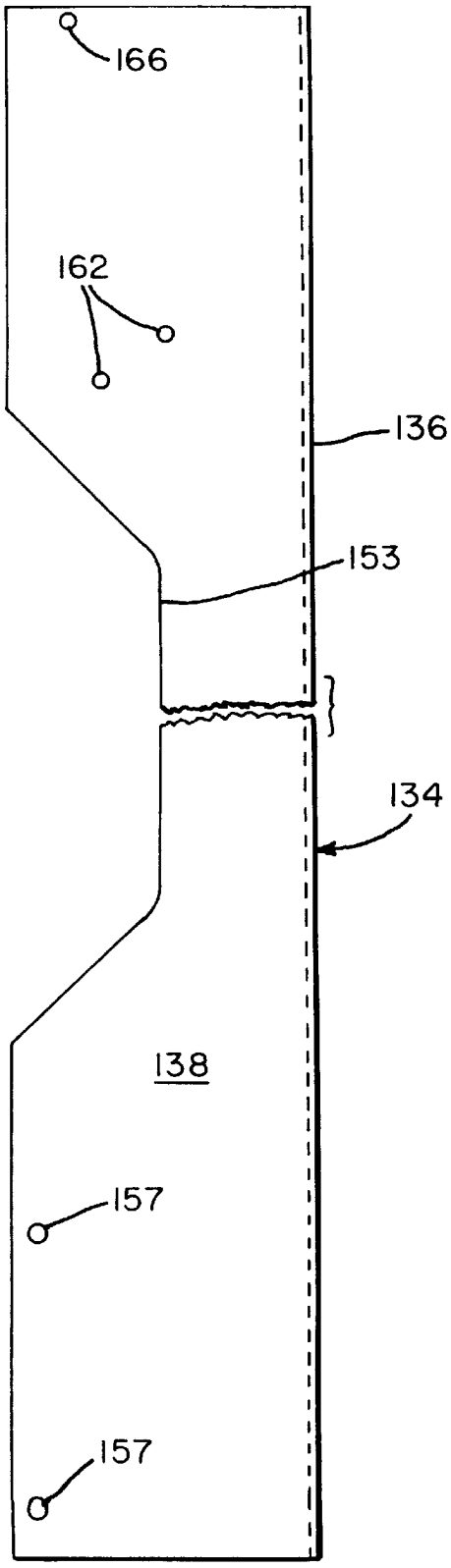
FIG. 17 is a side elevational view of a mast guard for partially covering or enclosing the mast member of the case sealer machine.

In order to define or establish such spaces or gaps 148, 150, 152, a mast spacer 154 is adapted to be secured to the bottom or lower end of the mast member 14 as best seen in FIG. 4, and the lower ends of the opposite side walls 138 of the mast guard 134 are fixedly secured to the mast spacer 154 by suitable fasteners 156 which pass through apertures 157 defined within the lower ends of the opposite side walls 138 of the mast guard 134. It will also be seen from FIGS. 1,2, and 4 that the lower end of the mast member 14, including the mast spacer 154, is adapted to be fixedly secured to the machine base assembly 12 by means of a plurality of bolt fasteners 158. In a similar manner, mast guard stand-offs 160 are adapted to be fastened to upper external portions of the side walls 140,142 of the mast member 14, and upper regions of the side walls 138 of the mast guard 134 are adapted to be fixedly secured to the mast guard stand-offs 160 by means of suitable fasteners which pass through apertures 162 defined within the upper regions of the side walls 138 of the mast guard 134 as best seen in FIG. 17. In this manner, the mast guard stand-offs 160 are fixedly interposed between the upper regions of the mast member 14 and the mast guard 134.

Figure 3:
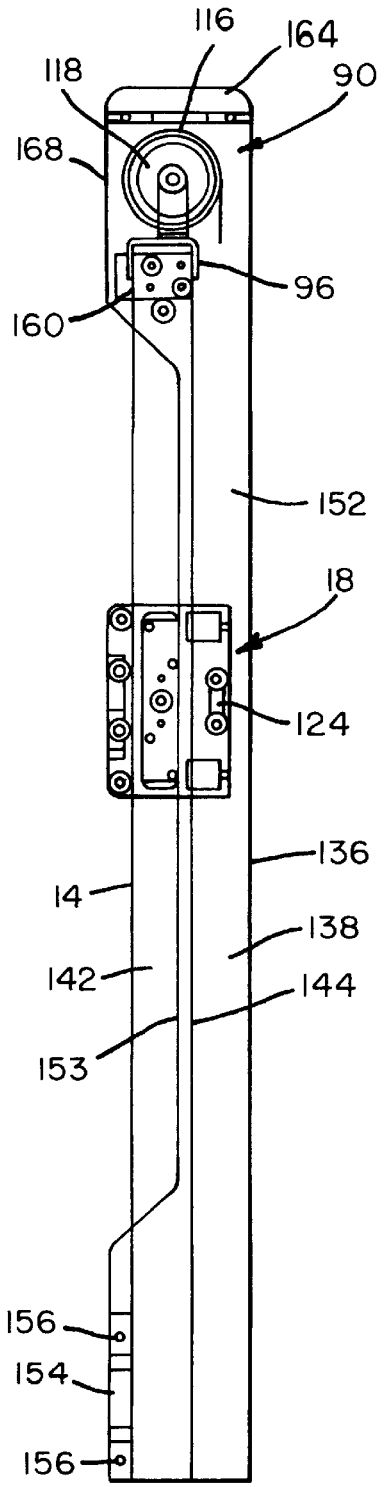
FIG. 3 is a side elevational view similar to that of FIG. 2 showing, however, only the mast and trolley assembly constructed in accordance with the principles and teachings of the present invention, and wherein the locking knob or clamping screw has been removed.
Figure 18:
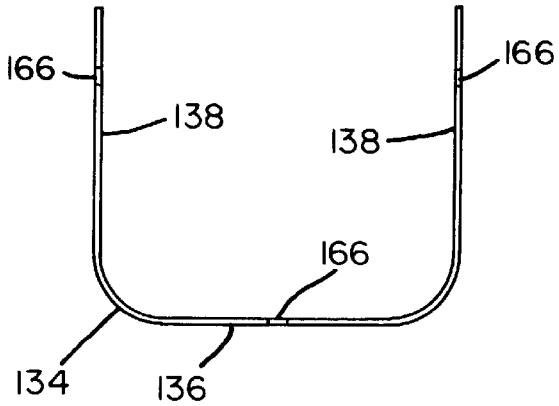
FIG. 18 is a top plan view of the mast guard illustrated in FIG. 17.
Figure 19:
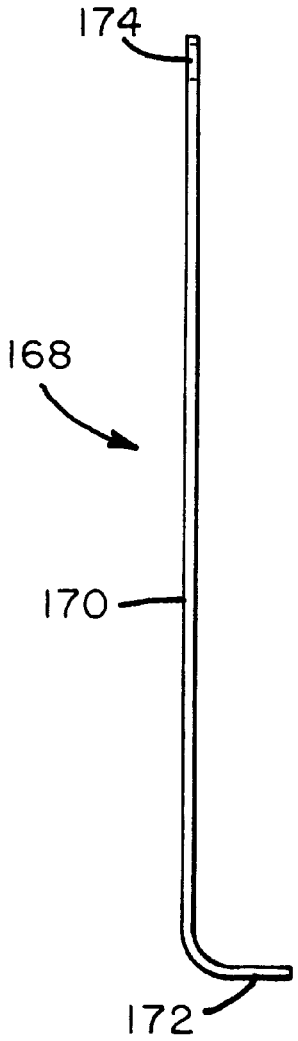
FIG. 19 is a side elevational view of a spring guard for covering the front of the spring mechanism.

The upper end of the mast guard 134, which as can be best appreciated from FIGS. 2 and 3 also serves to partially enclose the coil spring mechanism 90 upon three sides thereof, is provided with a mast guard cap 164. As shown in FIGS. 17 and 18, suitable apertures 166 are provided within the upper end portions of the mast guard rear wall 136 and the side walls 138 so as to receive suitable fasteners for insertion into the mast guard cap 164 in order to secure the mast guard cap 164 to the upper end portion of the mast guard 134. In order to entirely enclose the coil spring mechanism 90, a spring guard 168 is adapted to be secured to the mast guard cap 164. As more particularly shown in FIG. 19, the spring guard 168 essentially comprises a vertically extending plate portion 170 which has a curled lip portion 172 formed upon the bottom edge portion thereof for engaging the laterally spaced mast guard stand-offs 160 as may best be appreciated from FIG. 3. The upper end portion of the spring guard 168 is provided with a pair of laterally spaced apertures 174, only one of which is shown in FIG. 19, whereby suitable fasteners, not shown, can fixedly secure the spring guard 168 to a front portion of the mast guard cap 164 as may also be appreciated from FIG. 3. As a result of the provision of the spring guard 168, the mast guard cap 164, and the mast guard 134, it will be appreciated that the spring mechanism 90 is entirely enclosed on all four sides thereof, and in addition, the vertical disposition of the mast guard 134 likewise encloses the vertical extent of the coil spring 116 which extends, for example, between the spring hub member 118 and the spring block 124 so as to effectively eliminate any safety hazards for operator personnel.

Figure 20:
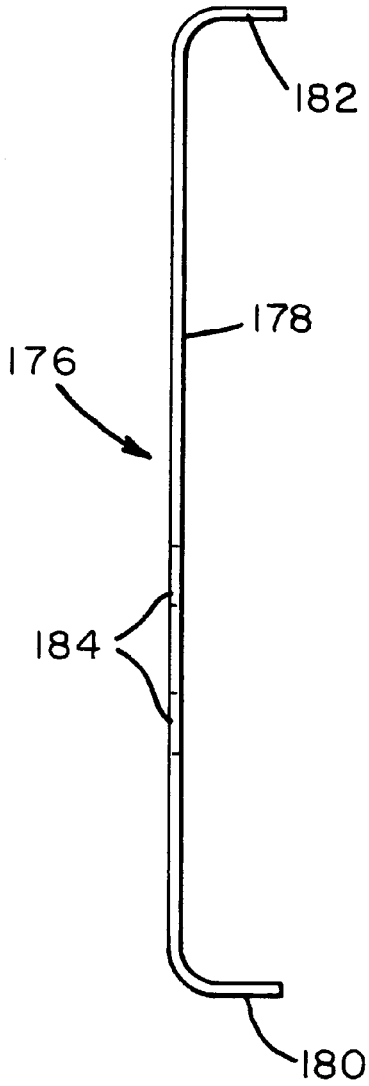
FIG. 20 is a side elevational view of a trolley guard covering the front of the trolley assembly.

With reference lastly being made to FIG. 20, a trolley guard 176 is illustrated, and the trolley guard 176 is adapted to be secured to the front side of the trolley assembly 18 so as to likewise cover the same in order to eliminate safety hazards with respect thereto, in particular in connection with the bearing members 36. The trolley guard 176 is seen to be similar in structure to the spring guard 168 and is seen to comprise a vertically extending plate portion 178 having lower and upper curled lip portions 180, 182 for respectively engaging lower and upper end portions of the trolley assembly 18. The trolley guard 176 is further provided with a plurality of apertures 184 through which suitable fasteners can extend so as to secure the trolley guard 176 upon the front surface portion of the trolley assembly 18. More particularly, the trolley guard 176 is adapted to be secured to the trolley front plate 72 by means of the same fasteners which extend through the bores 80 of the trolley front plate 72 and which attach the head assembly 16 to the trolley assembly 18 through means of the trolley front plate 72. In this manner, the trolley guard 176 is interposed or effectively sandwiched between the head assembly 16 and the trolley front plate 72 of the trolley assembly 18.

Thus, it may be seen that in accordance with the various teachings and principles of the present invention, there has been described a mast and trolley assembly structure which readily permits easy and simple vertical elevational adjustments of the trolley assembly and the head assembly carried thereby. In addition, the trolley assembly is mounted upon the mast member in a quickly and easily adjustable manner such that the vertical positional movements of the trolley assembly relative to the mast member are accomplished smoothly and without any play or chatter. The bolting systems for the various machine assemblies and components renders maintenance, repair, and exchange of components easy and simple to achieve, and in addition, the various guard members fixed upon the machine assemblies protect operator personnel from potential safety hazards.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A mast and trolley assembly for use in connection with a machine, comprising:

a vertically upstanding mast member;

a head assembly having components thereon for performing an operative function upon a product to be processed by the machine;

a trolley assembly having said head assembly affixed thereon and having a polygonal configuration so as to be mounted upon said vertically upstanding mast member in a surrounding manner for movement along said mast member between different vertical elevational positions;

first means mounted upon said trolley assembly for adjustably engaging at least one external surface of said mast member with varying degrees of force such that said trolley assembly is movable along said mast member in a stable manner between said different vertical elevational positions in a relatively smooth manner without any excessive play and chatter defined between said mast member and said trolley assembly; and second means mounted upon said trolley assembly for lockingly engaging said mast member so as to fix said trolley assembly at a particular elevational position along said mast member when said trolley assembly has been moved from a first one of said different vertical elevational positions to a second one of said different vertical elevational positions.

2. The mast and trolley assembly as set forth in claim 1, wherein said first means comprises:

a first set of bearing members mounted upon a first side of said trolley assembly along a fixed axis and engageable with a first side of said mast member; and a second set of bearing members mounted upon a second opposite side of said trolley assembly and along an axis which is movable toward and away from a second side of said mast member, which is opposite said first side of said mast member, so as to be engageable with said second side of said mast member; and means for adjustably engaging said second set of bearing members for moving said second set of bearing members toward said second side of said mast member so as to cause engagement of said second set of bearing members with said second side of said mast member whereby said trolley assembly can be snugly mounted upon said mast member as a result of engagement of said first and second sets of bearing members with said first and second opposite sides of said mast member.

3. The mast and trolley assembly as set forth in claim 2, further comprising:

a first wear strip fixedly mounted upon a third side of said trolley assembly for engaging a third side of said mast member; and a second wear strip adjustably mounted upon a fourth side of said trolley assembly, which is disposed opposite said third side of said trolley member, for adjustably engaging a fourth side of said mast member which is disposed opposite said third side of said mast member.

4. The mast and trolley assembly as set forth in claim 3, wherein:

said second means mounted upon said trolley member for lockingly engaging said mast member comprises a clamping screw adjustably mounted upon said trolley member and lockingly engageable with said mast member for locking said trolley member at a particular elevational position with respect to said mast member.

5. The mast and trolley assembly as set forth in claim 4, wherein:

said trolley assembly encircles said mast member; and said clamping screw is mounted upon said fourth side of said trolley member so as to lockingly engage said fourth side of said mast member.

6. The mast and trolley assembly as set forth in claim 2, further comprising:

a spring member mounted upon said mast member and operatively connected to said trolley assembly for counter-balancing the weight of said trolley and head assemblies such that said trolley and head assemblies can be vertically positioned with respect to said mast member in a stable, balanced manner.

7. The mast and trolley assembly as set forth in claim 6, wherein:

said spring member comprises a coiled member of spring steel.

8. The mast and trolley assembly as set forth in claim 6, further comprising:

a mast guard mounted upon said mast for substantially covering three sides of said mast member, three sides of said spring member, and three sides of said trolley assembly.

9. The mast and trolley assembly as set forth in claim 8, further comprising:

a mast cap mounted upon said mast guard for covering a top portion of said spring member; and a spring guard mounted upon said mast cap for covering a fourth side of said spring member.

10. The mast and trolley assembly as set forth in claim 8, further comprising:

a trolley guard for covering a fourth side of said trolley assembly upon which said first set of bearing members are disposed so as to protect operator personnel from any safety hazards potentially generated by said first set of bearing members.

11. The mast and trolley assembly as set forth in claim 8, wherein:

said mast guard has a substantially U-shaped cross-sectional configuration comprising three sides which are respectively spaced from said three sides of said mast member so as to respectively define three spaces with said three sides of said mast member within which said three sides of said trolley assembly are accommodated.

12. The mast and trolley assembly as set forth in claim 1, further comprising:

bolt fastener means for removably bolting said head assembly to said trolley assembly so as to facilitate removal and exchange of different head assemblies upon said trolley assembly.

13. A case sealer machine, comprising:

a vertically upstanding mast member;

a head assembly having components thereon for performing an operative function upon a product to be processed by the machine;

a trolley assembly having said head assembly affixed thereon and having a polygonal configuration so as to be mounted upon said vertically upstanding mast member in a surrounding manner for movement along said mast member between different vertical elevational positions;

first means mounted upon said trolley assembly for adjustably engaging at least one external surface of said mast member with varying degrees of force such that said trolley assembly is movable along said mast member in a stable manner between said different vertical elevational positions in a relatively smooth manner without any excessive play and chatter defined between said mast member and said trolley assembly; and second means mounted upon said trolley assembly for lockingly engaging said mast member so as to fix said trolley assembly at a particular elevational position along said mast member when said trolley assembly has been moved from a first one of said different vertical elevational positions to a second one of said different vertical elevational positions.

14. The machine as set forth in claim 13, wherein said first means comprises:

a first set of bearing members mounted upon a first side of said trolley assembly along a fixed axis and engageable with a first side of said mast member; and a second set of bearing members mounted upon a second opposite side of said trolley assembly and along an axis which is movable toward and away from a second side of said mast member, which is opposite said first side of said mast member, so as to be engageable with said second side of said mast member; and means for adjustably engaging said second set of bearing members for moving said second set of bearing members toward said second side of said mast member so as to cause engagement of said second set of bearing members with said second side of said mast member whereby said trolley assembly can be snugly mounted upon said mast member as a result of engagement of said first and second sets of bearing members with said first and second opposite sides of said mast member.

15. The machine as set forth in claim 14, further comprising:

a first wear strip fixedly mounted upon a third side of said trolley assembly for engaging a third side of said mast member; and a second wear strip adjustably mounted upon a fourth side of said trolley assembly, which is disposed opposite said third side of said trolley member, for adjustably engaging a fourth side of said mast member which is disposed opposite said third side of said mast member.

16. The machine as set forth in claim 15, wherein:

said second means mounted upon said trolley member for lockingly engaging said mast member comprises a clamping screw adjustably mounted upon said trolley member and lockingly engageable with said mast member for locking said trolley member at a particular elevational position with respect to said mast member.

17. The machine as set forth in claim 16, wherein:

said trolley assembly encircles said mast member; and said clamping screw is mounted upon said fourth side of said trolley member so as to lockingly engage said fourth side of said mast member.

18. The machine as set forth in claim 14, further comprising:

a spring member mounted upon said mast member and operatively connected to said trolley assembly for counter-balancing the weight of said trolley and head assemblies such that said trolley and head assemblies can be vertically positioned with respect to said mast member in a stable, balanced manner.

19. The machine as set forth in claim 18, wherein:

said spring member comprises a coiled member of spring steel.

20. The machine as set forth in claim 18, further comprising:

a mast guard mounted upon said mast for substantially covering three sides of said mast member, three sides of said spring member, and three sides of said trolley assembly.

21. The machine as set forth in claim 20, further comprising:

a mast cap mounted upon said mast guard for covering a top portion of said spring member; and a spring guard mounted upon said mast cap for covering a fourth side of said spring member.

22. The machine as set forth in claim 20, further comprising:

a trolley guard for covering a fourth side of said trolley assembly upon which said first set of bearing members are disposed so as to protect operator personnel from any safety hazards potentially generated by said first set of bearing members.

23. The machine as set forth in claim 20, wherein:

said mast guard has a substantially U-shaped cross-sectional configuration comprising three sides which are respectively spaced from said three sides of said mast member so as to respectively define three spaces with said three sides of said mast member within which said three sides of said trolley assembly are accommodated.

24. The machine as set forth in claim 13 further comprising:

bolt fastener means for removably bolting said head assembly to said trolley assembly so as to facilitate removal and exchange of different head assemblies upon said trolley assembly.

* * * * *